United States Patent [19]

Yamaki

[11] Patent Number: 4,468,548

[45] Date of Patent: Aug. 28, 1984

[54] COMPOSITE COOKING APPARATUS

[75] Inventor: Mitsuo Yamaki, Fuji, Japan

[73] Assignee: Tokyo Shibaura Denki Kabushiki Kaisha, Kawasaki, Japan

[21] Appl. No.: 341,172

[22] Filed: Jan. 20, 1982

[30] Foreign Application Priority Data

Jan. 23, 1981 [JP] Japan ..... 56-8779
Jan. 23, 1981 [JP] Japan ..... 56-7988[U]

[51] Int. Cl.[3] ..... H05B 9/02

[52] U.S. Cl. ..... 219/10.47; 219/10.49 R; 219/10.67; 219/525

[58] Field of Search ..... 219/524, 525, 445, 446, 219/447–448, 454, 466, 472, 474, 476, 477, 478, 479, 480, 10.49 R, 10.67, 10.47, 10.79, 10.55 B, 10.77; 99/340

[56] References Cited

U.S. PATENT DOCUMENTS

| | | | |
|---|---|---|---|
| 2,105,814 | 1/1938 | Lent | 219/446 |
| 2,873,343 | 2/1959 | Collopy | 219/10.47 |
| 3,587,555 | 6/1971 | Cerola | 219/446 |
| 3,790,750 | 2/1974 | Giannini | 219/525 |
| 4,002,875 | 1/1977 | Kiuchi et al. | 219/10.55 B |
| 4,042,806 | 8/1977 | McCartney | 219/446 |
| 4,163,896 | 8/1979 | McAvinn et al. | 219/525 |
| 4,191,875 | 3/1980 | Cunningham | 219/10.49 R |

FOREIGN PATENT DOCUMENTS

| | | | |
|---|---|---|---|
| 52-27091 | of 1977 | Japan . | |
| 50142544 | of 1977 | Japan . | |
| 52-40855 | 3/1977 | Japan | 219/10.47 |

*Primary Examiner*—B. A. Reynolds
*Assistant Examiner*—M. M. Lateef
*Attorney, Agent, or Firm*—Cushman, Darby & Cushman

[57] ABSTRACT

A first casing provided with an induction coil and a top plate as a first heater at the top thereof and a second casing provided with an electric heater as a second heater at the top thereof are hinged by a shaft and hinges such that the second casing can be opened and closed with respect to the first casing and can be held upright when the casing is opened. The power supply to the induction coil and the electric heater is commonly performed by a power unit provided in the first casing.

7 Claims, 7 Drawing Figures

COMPOSITE COOKING APPARATUS

BACKGROUND OF THE INVENTION

This invention relates to a composite cooking apparatus comprising a compact combination of at least two different kinds of cooking heaters.

Recently, induction heaters have been used as a household electric cooking heater. When in cooking with the induction heater, it is necessary to use a cooking tool made of iron, for instance an iron pan or an enameled pan. However, aluminum pans are comparatively frequently used in home cooking. Therefore, the electric heater and gas heater adapted for use of the aluminum pans are indispensable in the kitchen as well as the induction heater.

Therefore, the space of the home kitchen is generally occupied by a number of different kinds of cooking heaters, which is very inconvenient in view of the layout of the kitchen.

SUMMARY OF THE INVENTION

An object of the invention is to provide a composite cooking apparatus, which comprises a compact combination of at least two different kinds of cooking heaters and permits ensuring a satisfactory state of use of the individual heaters and also effective utilization of the kitchen space.

According to the present invention there is provided a composite cooking apparatus comprising a first casing including a first heating section disposed at the top thereof, and at least a second casing including a second heating section arranged at the top thereof, the second casing being hinged to the first casing such that it can be opened and closed with respect to the first casing, one of the first and second heating sections having an induction heater while the other of the first and second heating sections having a heater which is different from the induction heater.

DETAILED DESCRIPTION OF THE PREFERRED EMBODIMENTS

Figure 1A:
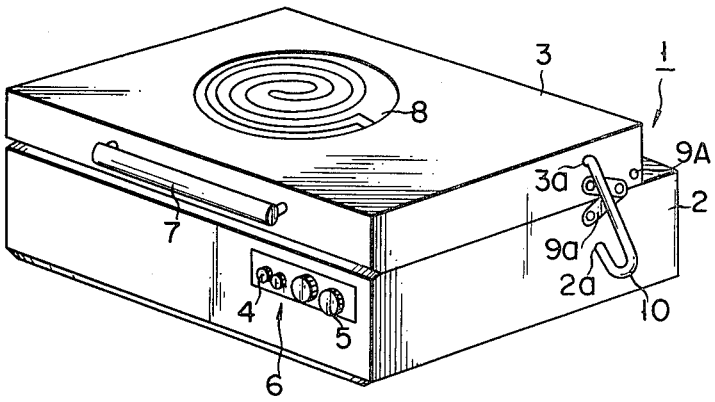
FIG. 1A is a perspective view showing one embodiment of the composite cooking apparatus according to the invention in a state of use as an electric heater.
Figure 1B:
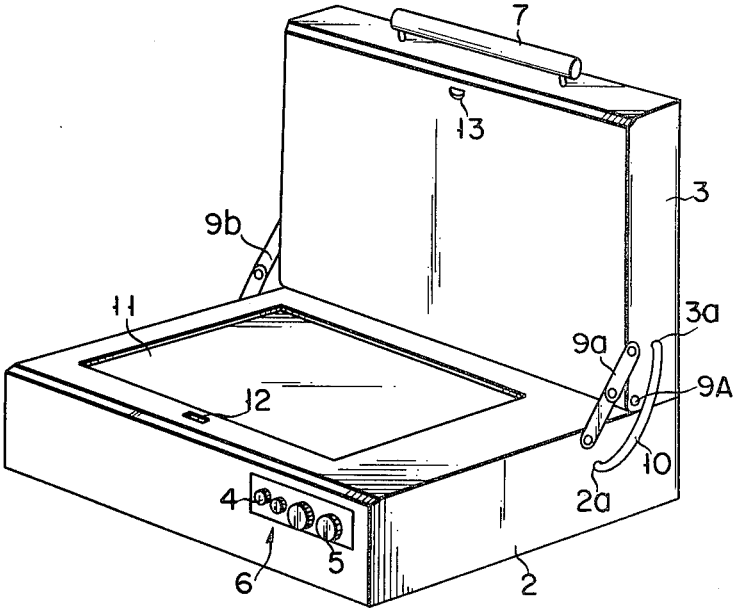
FIG. 1B is a perspective view showing the same embodiment in a state of use as an induction heater.

Referring to FIG. 1A, there is shown one embodiment of the composite cooking device 1, which essentially comprises a first casing 2 and a second casing 3. FIG. 1A shows the cooking device with the second casing 3 placed on the first casing 2. The casing 2 is provided at the front with an operating panel 6 having a power switch 4, a power control knob 5, etc. The casing 3 is provided at its front with a handle 7 and its top with an electric heater 8. FIG. 1B shows the cooking device 1 in an open state. The casings 2 and 3 are provided near the rear end of their opposite sides with a pair of hinges 9*a* and 9*b* and are provided at the rear end with a shaft 9A. The hinges 9*a*, 9*b* and the shaft 9A serve to hold the casing 3 in its upright position in the open state of the device shown in FIG. 1B. The casings 2 and 3 are provided on the side provided with the hinge 9*a* and near the hinge 9*a* with respective see-through holes 2*a* and 3*a*. A lead 10 is led out from the casing 2 through the hole 2*a* and into the casing 3 through the hole 3*a*. The lead 10 is used to supply power from a heater drive circuit to be described later to the electric heater 8.

The casing 3 may be brought from its horizontal state shown in FIG. 1A to its upright state shown in FIG. 1B by gripping the handle 7 provided at its front. In the state of FIG. 1B, a top plate 11 of a cooking unit of the induction heating type, which is provided on top of the casing 2, is exposed. In this state, the casing 3 is steadily held upright by the hinges 9*a*, 9*b* and the shaft 9A with its rear end flat surface in close contact with the top flat surface of the casing 2. The top of the casing 2 is formed near its front edge with a recess 12, and the underside of the casing 3 is provided at a position corresponding to the recess 12 with a projection 13. At the bottom of the recess 12 a microswitch to be described later is provided, and the projection 13 serves as an actuator for this microswitch.

Figure 2:
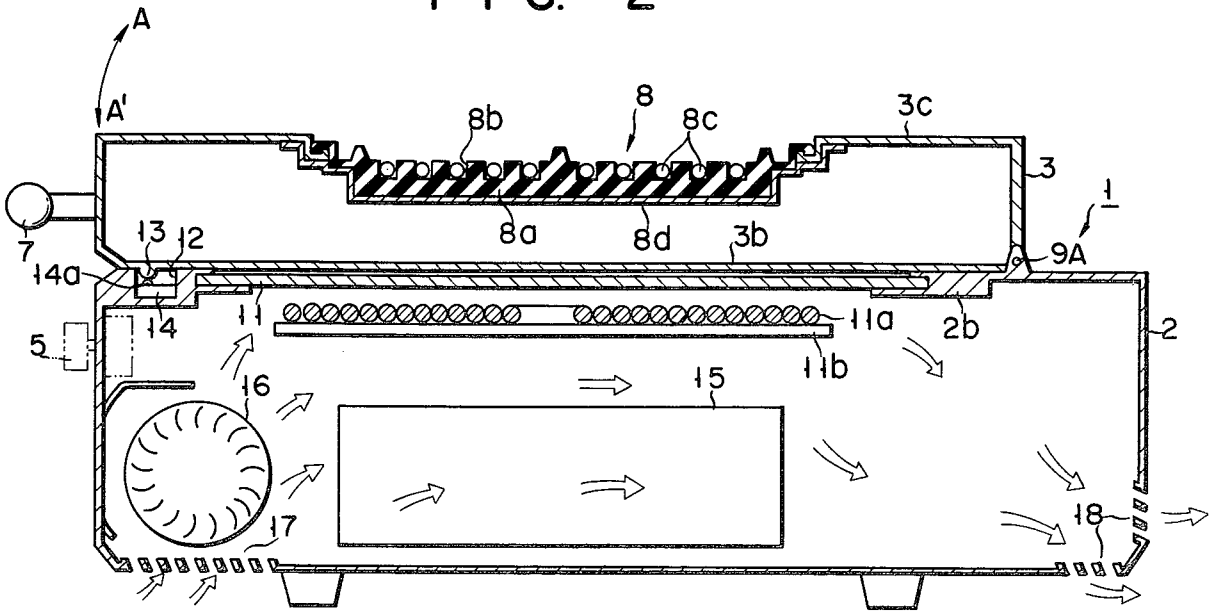
FIG. 2 is a schematic sectional view showing the internal construction of the same embodiment in the state of FIG. 1A.

FIG. 2 shows the internal construction of this embodiment. The electric heater 8 includes a spiral electric heating wire 8*c* which is received in a sprial groove 8*b* formed in the upper surface of a heatresistant insulator 8*a*. The heat-resistant insulator 8*a* serves as a support for the electric heating wire 8*c*, and the underside of the heat-resisting insulator 8*a* is supported by a metal support plate 8*d* in order to increase its mechanical strength and also reduce radiation of heat of the electric heating wire 8*c* to the top plate 11 of the induction heating type cooking unit through the bottom plate 3*b* of the casing 3. The edge of the metal support plate 8*d* is secured to the underside of the top plate 3*c* of the casing 3.

In the state of the cooking device shown in FIG. 2, an operating button 14*a* of the microswitch 14 provided in the recess 12 is held downwardly urged by the lower end of the projection 13, and thus the movable contact of the microswitch is held in contact with one of its fixed contacts. In this state, the output of a power unit 15 provided inside the casing 2 is supplied to the electric heater 8 according to the output of the microswitch 14, and the electric heating wire 8*c* is supplied with power through the lead 10. This function is provided by a heater drive circuit to be described later.

Beneath the top plate 11 which is mounted in the top plate 2*b* of the casing 2, an induction heating coil 11 *a* is supported on a support plate 11*b* such that it is suitably spaced apart from and extends substantially parallel with the top plate 11. The support plate 11*b* is insulated from the coil 11*a*. In the state of FIG. 2, no output from an induction heating coil drive circuit in the power unit 15 is supplied to the induction coil 11*a*. However, there is some heat radiation from the electric heating wire 8*c* and also there is heat generation from the power unit 15, and the effect of these heat fluxes on the electric parts in the power unit 15 cannot be ignored. Accordingly, in this embodiment a cooling fan 16 is provided in a front part of the interior of the casing 2 for withdrawing air from an air inlet 17 formed in a front portion of the bottom plate of the casing 2 and causing it to flow along the coil 11*a* and power unit 15 and be discharged through an air outlet 18 provided in a lower portion of the back plate of the casing 2. In this way, the coil 11*a* and power unit 15 can be effectively cooled. In the state of FIG. 2, by turning on the power switch 4 the heater drive circuit in the power unit 15 is immediately rendered operative to supply power through the lead 10 to the electric heating wire 8*c*, thus heating the heating wire 8*c*. At the same time, a blower motor is started to drive the cooling fan or blower 16. The quantity of heat generated from the heating wire 8*c* in this state can be controlled by operating the power control knob 5. In this way, cooking can be obtained with, for instance, an aluminum pan placed on the electric heater 8.

When the casing 3 is brought to the upright position shown in FIG. 1B, the operating button 14*a* of the microswitch 14 is separated from the projection 13, causing the movable contact of the microswitch to be switched into contact with the other fixed contact. When the power switch 4 is turned on in this state, the induction heating coil drive circuit in the power unit 15 is rendered operative to supply high frequency power to the induction heating coil 11*a*. The frequency at this time is set to, for instance, 20 to 30 kHz. When the high frequency power is supplied in this way, a high frequency magnetic field is generated from the coil 11*a*. This magnetic field penetrates the top plate 11, which is made of a non-magnetic material, and reaches the top thereof. Thus, by placing an iron pan, for instance, on the top plate 11, heating due to iron loss produced in the iron pan can be obtained for cooking. Again in this casing, the cooling fan 16 is driven as soon as the power switch 4 is turned on, and also the heating temperature can of course be controlled by operating the power control knob 5.

Figure 3:
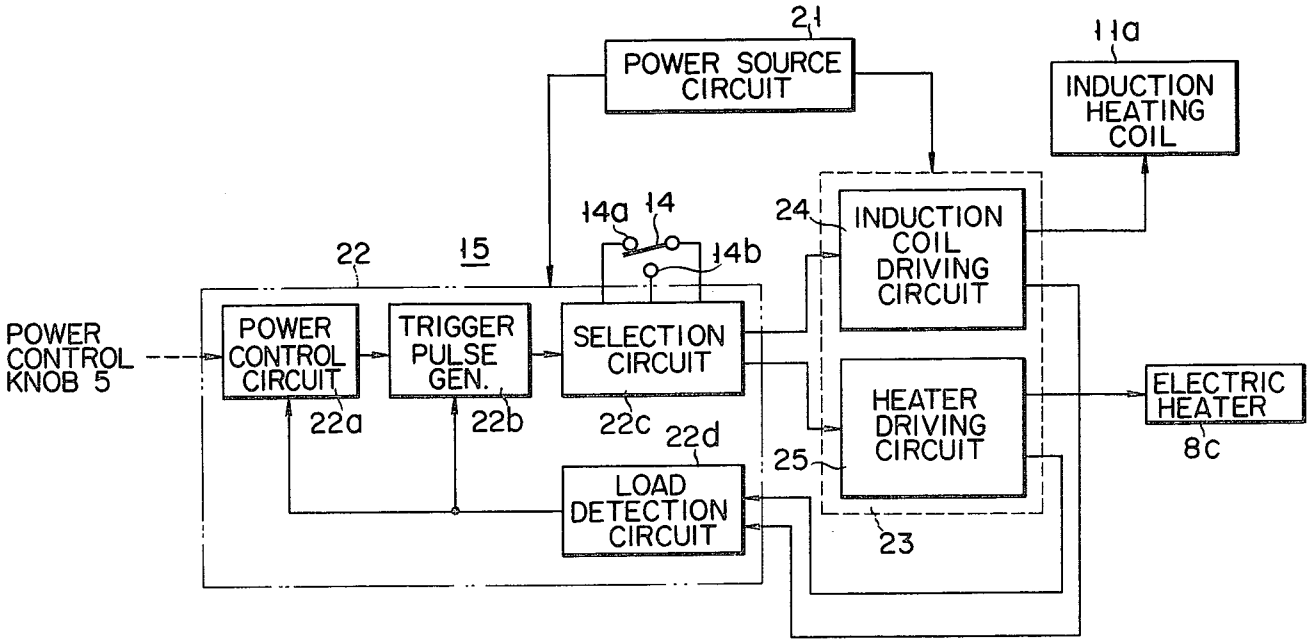
FIG. 3 is a block diagram showing a control system for permitting selective use of the embodiment as the induction heater or electric heater.
Figure 4:
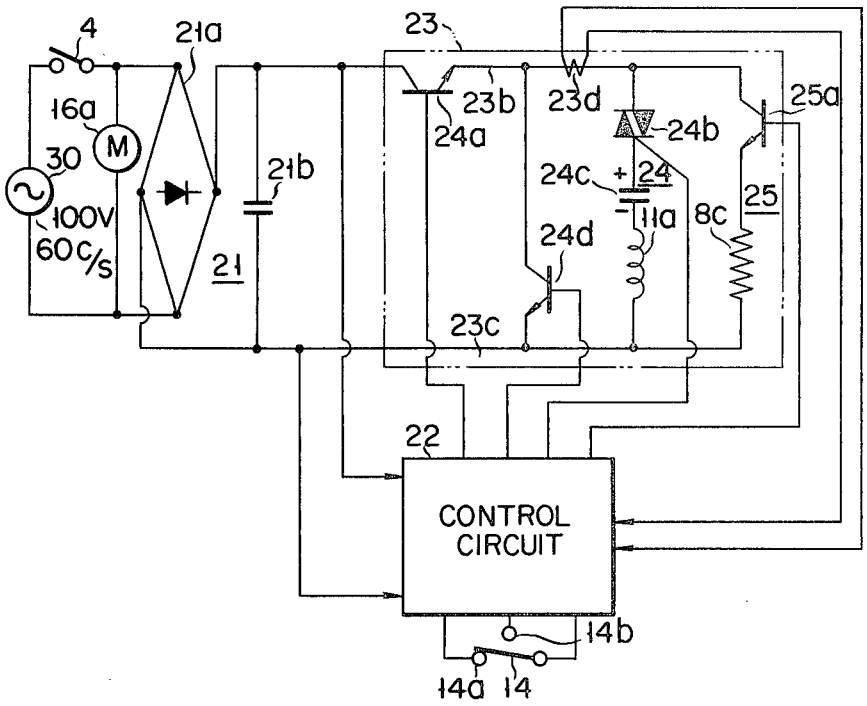
FIG. 4 is a circuit diagram showing the entire circuit construction of the embodiment.

Now, the electric circuit of this embodiment will be described with reference to FIGS. 3 and 4. In FIG. 3, the power unit 15 shown in FIG. 3 comprises a power source circuit 21, a control circuit 22 energized by the output of the power source circuit 21 and a drive circuit section 23 including an induction heating coil drive circuit 24 and a heater drive circuit 25.

The control circuit 22 has a power control circuit 22*a* for providing a power control signal of a level corresponding to the extent of operation of the power control knob 5 to a trigger pulse generating circuit 22*b*. The trigger pulse generating circuit 22*b* supplies a trigger pulse having a frequency corresponding to the level of the given power control signal to a selecting circuit 22*c*. For example, when the power control knob 5 is operated in the direction of increasing the output level from the heater 8*c* or coil 11*a*, the level of the power control signal is increased to correspondingly reduce the frequency of the trigger pulse. The trigger pulse that is produced in this way is coupled through the selecting circuit 22*c*, which is operated by the output of the microswitch 14, to the induction heating coil drive circuit 24 or heater drive circuit 25. For instance, when the casing 3 is in the state of FIG. 1A or 2, the microswitch 14 is set to the side of a fixed contact 14*a*, and the selecting circuit 22*c* transmits a trigger pulse output to the heater drive circuit 25. As a result, the output of the power source circuit 21 is supplied through the heater drive circuit 25 to the electric heating wire 8*c*. When the casing 3 is in the state of FIG. 1B, the microswitch 14 is set to the side of the other fixed contact 14*b*, and the selecting circuit 22*c* transmits a trigger pulse output to the induction heating coil drive circuit 24. Thus, the output of the power source circuit 21 is converted through the circuit 24 into a high frequency wave which is supplied to the induction heating coil 11*a*.

The quantity of power consumed in the electric heating wire 8*c* or induction heating coil 11*a* is detected in a load detecting circuit 22*d* provided in the control circuit 22. According to the detected output, the operation of the power control circuit 22*a* and trigger pulse generating circuit 22*b* is controlled, if necessary, for controlling the timing of a trigger pulse generated from the circuit 22*b*.

Now, the circuit construction shown in FIG. 3 will be described in detail with reference to FIG. 4. Referring to FIG. 4, the power source circuit 21 includes a full-wave rectifying circuit 21*a* using a diode and a smoothing capacitor 21*b* for smoothing the rectified output. The AC input terminals of the full-wave rectifying circuit 21*a* are connected across the AC power source 30 via the power switch 4 and are also connected across the blower motor 16*a* for the cooling fan 16. The positive output terminal of the power source circuit 21 is connected through the collector-emitter path of a transistor 24*a* in the drive circuit section 23 to a positive line 23*b* and also connected to the positive input terminal of the control circuit 22. The negative output terminal of the power source circuit 21 is commonly connected to the negative line 23*c* of the drive circuit 23 and to the negative input terminal of the control circuit 22.

Between the positive and negative lines 23*b* and 23*c* of the drive circuit section 23 a bidirectional thyristor 24*b* and resonant capacitor 24*c* are connected in series with the induction heating coil 11*a*, and between the lines 23*b* and 23*c* a series circuit consisting of the collector-emitter path of a transistor 25*a* and an electric heating wire 8*c* is connected. Further, the collector-emitter path of a transistor 24*d* is connected between the emitter of a transistor 24 *a* and negative line 23*c*. The transistors 24*a* and 24*d*, bidirectional thyristor 24*b* and resonant capacitor 24*c* constitute the drive circuit 24 for the induction heating coil 11*a*. The transistor 25*a* constitutes the drive circuit 25 for the electric heating wire 8*c*.

The control circuit 22 supplies conduction control outputs at predetermined timings to the control gates of the transistors 24*a*, 24*d* and 25*a* and bidirectional thyristor 24b. The current flowing through the positive line 23*b* is detected by a current transformer (CT) 23*d*, and the output of the CT 23*d* is supplied to the load detection circuit 22*d* in the control circuit 22.

Now, the operation of the circuit shown in FIG. 4 will be described. When the casing 3 of the cooking device is in the state of FIG. 1A, the transistor 25*a* is held "on" by the output from the control circuit 22. In this state, the bidirectional thyristor 24*b* and transistor 24*d* of "off". When the power control knob 5 is then set to the maximum output position, a continuous "on" signal is supplied from the control circuit 21 to the electric heating wire 8*c*. In this state, the power consumption in the electric heating wire 8*c* is 800 Watts.

By operating the power control knob 5 in this state, the control circuit 22 provides a pulse output with the pulse width thereof varying according to the extent of operation of the knob to the base of the transistor 24*a*, whereby the transistor 24*a* is correspondingly on-off controlled to on-off control the current flowing through the electric heating wire 8*c* so as to control the quantity of heat generated from the heating wire 8*c*.

When the casing 3 is in the position of FIG. 1B, the transistor 25*a* is held "off" and the bidirectional thyristor 24*b* is held "on" by the output of the control circuit 22. At this time, if the transistor 24*a* is "on" and the transistor 24*d* is "off", the DC current from the power source circuit 21 flows through the bidirectional thyristor 24*b* and induction heating coil 11*a*, whereby the resonant capacitor 24*c* is charged to the same polarity. Then, the transistor 24*a* is turned "off" and the transistor 24*d* "on" by the output of the control circuit 22, and the resonant capacitor 24*c* is discharged to cause current through the bidirectional thyristor 24*b* and transistor 24*d* to the induction heating coil 11*a* in the opposite direction to that mentioned above. In this way, the transistors 24*a* and 24*d* are repeatedly turned on and off alternately and at a high rate. Thus, high frequency current at 20 to 30 kHz is caused through the induction heating coil 11*a*. The high frequency current at this time is detected by the CT 23*d*, and the detection output is fed to the load detecting circuit 22*d* in the control circuit 22. As a result, the pulse width of the trigger pulse output from the trigger pulse generating circuit 22*b* is controlled such that it is increased when the charging current to the resonant capacitor 24*c* is less than a predetermined value.

With the induction heater and electric heater combined together such that they are placed one above another, it is possible to permit a plurality of different cooking heaters to be freely used in a narrow kitchen area without any space factor problem. In addition, with the upper heater hinged to the lower heater such that it is capable of being opened with respect to the lower heater, it is possible to sufficiently ensure the satisfactory state of use of each heater. Further, while the power supply to the electric heater is usually controlled stepwise through heater tap switching, in this embodiment the power supply to the electric heater and that to the induction heater are commonly controlled through on-off control according to a periodically recurring trigger pulse signal. Thus, the construction of the control circuitry can be simplified, and the output control particularly at the time of the cooking with the electric heater can be made finely similar to the output control at the time of the cooking with the induction heater, which is very convenient. Further, a single power control knob can be commonly used, and the operability is very satisfactory.

While in the above embodiment the induction heater is provided on the stationary side (i.e., lower side) and the electric heater is provided on the openable side (i.e., upper side), it is also possible to set the electric heater on the stationary side (i.e., lower side). This can be determined suitably depending upon the frequency of use of the individual heaters and status of the kitchen. Further, it is possible to incorporate a gas heater as a heating unit. Further, it is possible to provide one or two additional heaters on the upper and lower stage heaters as described.

Figure 5:
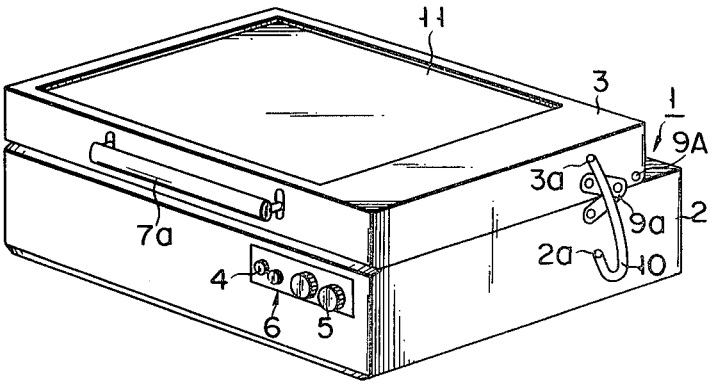
FIG. 5 is a perspective view showing a different embodiment of the composite cooking apparatus in a state of use as the induction heater.
Figure 6:
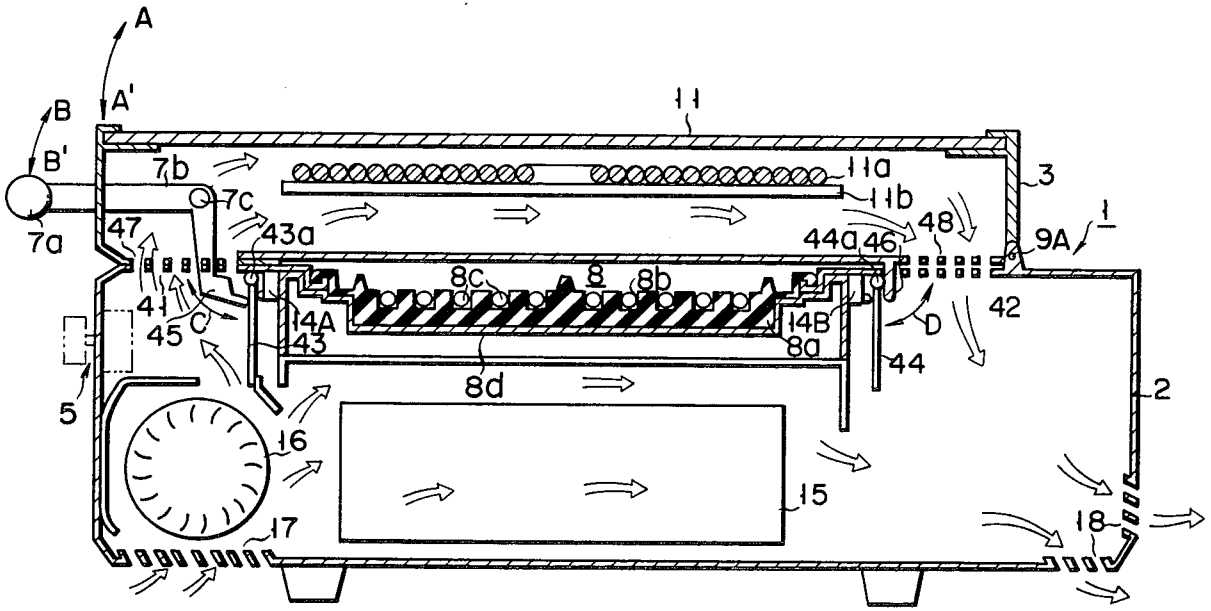
FIG. 6 is a schematic sectional view showing the internal construction of the embodiment of FIG. 5.

FIGS. 5 and 6 are a perspective view and a sectional view showing a different embodiment of the invention. In this embodiment, the arrangement of the heaters in the embodiment of FIG. 1A is reversed. More particularly, electric heater 8 is provided in the casing 2, and induction heater is provided in the casing 3. In the Figures, corresponding parts to those in FIGS. 1A, 1B and 2 are designated by like reference numerals.

Referring to FIGS. 5 and 6, the electric heater 8 is provided as a first heating section on top of the first casing 2, and the casing 2 is provided with an air outlet 41 and an air inlet 42 on the front and rear sides of the electric heater 8 respectively. Dampers 43 and 44 are provided on the innter side of the air outlet 41 and air inlet 42 respectively. In the opened state of the second casing 3, the dampers 43 and 44 are held in close contact with the air outlet 41 and air inlet 42 by the biasing forces of springs (not shown), thus blocking air flow with respect to the outside of the casing 2. In the closed state of the second casing 3, the dampers 43 and 44 are held open by damper opening pawls 45 and 46 to be described later against the spring forces of the springs, thus forming air passages between the casings 2 and 3 as shown.

The second casing 3 is provided at the top with a top plate 11 of an induction heater as a second heating section, and an induction heating coil 11*a* is provided inside the casing 3 such that it faces the top plate 11. The bottom plate of the second casing 3 is provided on the front side with an air inlet 47 corresponding to the air outlet 41 of the first casing 2 and on the rear side with an air outlet 48 corresponding to the air inlet 42 of the first casing 2. In a front portion of the interior of the second casing 3, a lever 7*b* is pivotably mounted substantially at its central portion on the pin 7*c*. One end portion of the layer 7*b* constitutes a grip 7*a* which penetrates the front wall of the second casing 3 and is movable in the direction of arrow B–B'. The other end portion of the lever constitutes a damper opening pawl 45 penetrating the top wall of the casing 2 and bottom wall of the second casing 3. The damper opening pawl 45 is found inside the first casing 2 and tends to open the damper 43 against a spring biasing force (not shown) when closing the second casing 3. A damper opening pawl 46 is provided as a projection in a rear portion of the bottom plate of the second casing 3 in the neighborhood of the air outlet 48. The damper opening pawl 46 is found in the first casing 2 and opens the damper 44 against the spring biasing force when closing the second casing 3. Thus, the dampers 43 and 44 are rotated in the direction of arrows C and D about the respective pins 43*a* and 44*a*.

Inside the first casing 2, microswitches 14A and 14B for detecting the opening of the dampers 43 and 44 are provided, and a power supply control mode for the induction heater and that for the electric heater 8 are switched in the control section 15 with the operation of the switches 14A and 14B.

Now, the operation of the above construction will be described.

When in cooking with the induction heater, the second casing 3 is closed, and an iron or enameled pan containing the food to be cooked is placed on the top plate 11. At this time, the dampers 43 and 44 are opened with the closure of the second casing 3. Thus, air passages are formed between the first and second casings 2 and 3, and also the microswitches 14A and 14B are turned on to switch the control section 15 to the power supply control mode for the induction heater cooking. When the power source switch 4 is closed after the preparations for the cooking are completed, the control section 15 and induction heating coil 11*a* are energized to start the cooking of well-known induction heating. At the same time, the cooling fan 16 is operated, whereby air withdrawn from the air inlet 17 is supplied as cooling air to the control section 15 while part of the cooling air is supplied through the air outlet 41 and air inlet 47 to the induction heating coil 11*a*. The cooling air having passed by the induction heating coil 11*a* passes through the air outlet 48 and air inlet 42 and discharged together with the cooling air having passed by the control section 15 through the air outlet 18.

When in cooking with the electric heater 8, the second casing 3 is opened by raising the grip 7*a*, and a pan containing the food to be cooked is placed on the electric heater 8. With the opening of the second casing 3, the dampers 43 and 44 are closed for preventing the intrusion of dust or foodstuff particles into the first casing 2. At the same time, the microswitches 14A and 14B are turned off to switch the control section 15 to the power supply control mode for the electric heater cooking. When the power source switch is closed after the preparations for the cooking are completed, cooking by heat generated from the electric heater 8 is started. In this case, if a commercial AC power source, for instance of 100 V, 60 Hz, is directly used for the electric heater 8, the cooling of the control section 15 is not required, and thus the cooling fan 16 need not be operated.

It is to be understood that with the top plate 11 and induction heating coil 11*a* of the induction heater provided on the second casing 3 capable of being opened and closed and the control section 15 of the induction heater provided together with the electric heater 8 and cooling fan 16 in the stationary first casing 2, while also permitting air passages to be formed between the first and second casings 2 and 3 by the dampers 43 and 44 which are opened with the closing of the second casing 3, the cooling of the control section 15 and induction heating coil 11*a* at the time of the induction heater cooking can be done efficiently with the single cooling fan 16. Since there is no need of using two cooling fans, it is possible to adopt the function of the induction heater cooking incorporated in the stationary second casing without increase of cost and also without any problem in the construction.

While the above embodiment has concerned with a case where the electric heater 8 is used as the first heating section provided in the first casing 2, it is also possible to use other heaters such as a gas heater as the first heating section.

As has been described in the foregoing, with the above embodiment, in which air passages are formed between the stationary first casing and the second casing capable of being opened and closed by the dampers that are closed at the time of the closing of the second casing, it is necessary to provide only a single cooling fan. Thus, it is possible to provide a composite cooking apparatus, with which the function of the induction heater cooking can be provided in the casing capable of being opened and closed without need of increasing the cost and also without any problem in the construction.

What is claimed is:

1. A composite cooking apparatus comprising an upper casing including a first heating section provided at the top thereof; at least a lower casing including a second heating section provided at the top thereof, said upper casing being hinged to said lower casing such that the former can be opened and closed with respect to the latter, one of said first and second heating sections having an induction heater while the other of said first and second heating sections has an electric heater; means for driving said induction heater; means for driving said electric heater; and control means for controlling the operation of said induction heater driving means and said electric heater driving means, said control means including a power control circuit, a trigger pulse generator for generating a trigger pulse in response to an output signal of said power control circuit, and a selection circuit for selectively providing the trigger pulse to said induction heater driving means and said electric heater driving means.

2. The composite cooling apparatus according to claim 1 wherein said upper casing is hinged to said lower casing by a pair of hinges, said upper casing being held in a upright open state on said lower casing with said hinges in an expanded state.

3. The composite cooking apparatus according to claim 2, wherein said control means further includes a load detection circuit coupled to said induction heater driving means and said electric heater driving means to control the pulse width of the trigger pulse generated by said trigger pulse generator in response to the load conditions of said induction heater driving means, and which further comprises a common power unit provided inside said first casing and capable of supplying power to said first and second heating sections and means for switching the output of said common power unit according to the position of said second casing with respect to said first casing.

4. The composite cooking apparatus according to claim 3, which further comprises a cooling fan provided inside said lower casing and driven with the closure of power source, and also in which said lower casing is provided with an air inlet and an air outlet to permit cooling air to be introduced from the outside and discharged after cooling said induction heater and said common power unit.

5. The composite cooking apparatus according to claim 2, wherein said lower and upper casings are respectively provided with an electric heater and an induction heater, said lower casing accommodates a common power unit capable of supplying power to said first and second heating sections and a cooling fan, said lower and upper casings are formed with openings forming air passages communicating said lower and upper casings in the closed state of said casing, and the openings formed in saif first casing are closed by dampers in the closed state of said upper casing.

6. The composite cooking apparatus according to claim 5, wherein said upper casing is provided with means for setting said dampers to an open position when said upper casing is brought to the closed state.

7. The composite cooking apparatus according to any one of claims 3 to 6, wherein said common power unit includes rectifying means for converting a commercial AC voltage into a DC voltage and said induction heater driving means includes an on-off control transistor for regulating a current supplied from said rectifying means to said induction heater driving means in response to the output signal of said control means, a bidirectional switching circuit, a resonant capacitor connected in series with said bidirectional switching circuit and said resonant capacitor, and a switching transistor which is turned on in response to the output signal of said control means in order for said induction heater driving means energize said induction heater when said on-off control transistor is turned off, and said electric heater driving means includes a driving transistor for providing the DC voltage to said electric heater in response to the output signal of said control means, and a drive circuit for selectively coupling the output of said rectifying circuit to said induction heater and electric heater according to the output of said control circuit.

* * * * *